United States Patent [19]

Bailey

[11] Patent Number: 4,865,257

[45] Date of Patent: Sep. 12, 1989

[54] SPRAY GUARD ADAPTED FOR USE WITH A WAND FOR SPRAYING A LIQUID ONTO VEGETATION

[76] Inventor: Amy L. Bailey, 605 33 Rd, Rte. 1, Clifton, Colo. 81520

[21] Appl. No.: 221,558

[22] Filed: Jul. 20, 1988

[51] Int. Cl.[4] ..... B05B 1/28; B05B 15/04

[52] U.S. Cl. ..... 239/288.5; 239/499

[58] Field of Search ..... 239/288–288.5, 239/499; 285/161, 205

[56] References Cited

U.S. PATENT DOCUMENTS

| | | | |
|---|---|---|---|
| 1,219,642 | 3/1917 | Isaacs | 239/288.5 |
| 1,760,274 | 5/1930 | Minor | 239/288.5 |
| 2,566,878 | 9/1951 | Fahrenkrog et al. | 239/288.5 |
| 2,807,816 | 10/1957 | O'Brien | 239/288.5 |
| 2,893,648 | 7/1959 | Berry | 239/288.5 |
| 2,928,610 | 3/1960 | Fenimore | 239/288.5 |
| 3,092,334 | 6/1963 | Peterson | 239/288.5 |
| 3,118,607 | 1/1964 | Rocher | 239/288.3 |
| 3,405,669 | 10/1968 | Nimrick | 239/288.5 |
| 3,672,380 | 6/1972 | Schuster | 239/288.5 |
| 3,770,204 | 11/1973 | Schuster | 239/288.5 |

FOREIGN PATENT DOCUMENTS

| | | | |
|---|---|---|---|
| 820944 | 9/1959 | United Kingdom | 239/288.5 |
| 1513711 | 6/1978 | United Kingdom | 239/288.5 |
| 82/03799 | 11/1982 | World Int. Prop. O. | 239/288.5 |

*Primary Examiner*—Andres Kashnikow
*Assistant Examiner*—Karen B. Merritt

[57] ABSTRACT

A spray guard adapted for use with a wand for spraying a liquid onto vegetation, the wand having a cylindrically shaped discharge tube and a nozzle tip attached to the end of the discharge tube. The spray guard includes a dome having an open end and provided with an aperture through which the discharge tube may selectively extend. The dome channels, directs, and forcuses the spray emitted from the nozzle tip toward a relatively localized area.

17 Claims, 1 Drawing Sheet

SPRAY GUARD ADAPTED FOR USE WITH A WAND FOR SPRAYING A LIQUID ONTO VEGETATION

BACKGROUND OF THE INVENTION

The present invention relates to a spray guard adapted for use with a wand for spraying a liquid onto vegetation. Such wands normally include a cylindrically shaped discharge tube and a nozzle tip attached to the end of the discharge tube. The liquid flows from a container, through the discharge tube, through the nozzle tip, and onto the vegetation. A drawback of using such wands is that the liquid is sometimes wasted by being sprayed in directions other than onto the desired vegetation. For example, if one wishes to apply an insecticide onto vegetation, such wands waste insecticide by spraying the insecticide into the air, onto adjacent ground, onto adjacent vegetation, etc. Also, if the liquid is designed to kill the vegetation, such as a defoliant, then such wands also often result in the liquid being sprayed and carried by wind onto other nearby vegetation that one does not want killed. For example, if one desires to apply a defoliant to weeds, such wands often cause a defoliant to be sprayed onto nearby desirable vegetation such as flowers, vegetables, shrubs, etc. Consequently, there is a need to direct such sprays only onto the intended vegetation

SUMMARY OF THE INVENTION

The present invention relates to a spray guard adapted for use with a wand for spraying a liquid onto vegetation, the wand having a cylindrically shaped discharge tube and a nozzle tip attached to the end of the discharge tube. The spray guard includes a dome having an open end and provided with an aperture through which the discharge tube may selectively extend. The dome channels, directs, and focuses the spray emitted from the nozzle tip toward a relatively localized area.

BRIEF DESCRIPTION OF THE DRAWINGS

The invention will be described with reference to the accompanying drawings, wherein.

DESCRIPTION OF A PREFERRED EMBODIMENT

Figure 1:
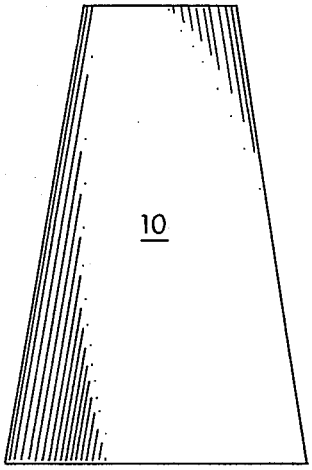
FIG. 1 is a side view of the spray guard in accordance with one embodiment of the present invention.

The present invention will be described with reference to the accompanying drawings wherein like reference numerals refer to the same item.

Figure 2:
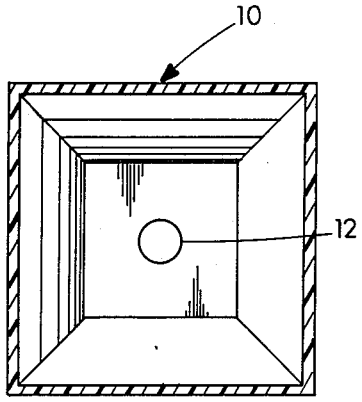
FIG. 2 is a bottom view of the spray guard shown in FIG. 1; .

There is shown in FIG. 1 a spray guard in accordance with one embodiment of the present invention. The spray guard comprises a dome 10 fashioned in the shape of a truncated pyramid. The dome 10 is preferably nine inches high, six inches square at the base, and three inches square at the upper end. The base end of the dome 10 is open, as best shown in FIG. 2. The upper end of the dome 10 is provided with a centrally disposed, circular aperture 12. The dome 10 may be fashioned of metal or other material, and is preferably fashioned of clear, rigid plastic having a thickness of three thirty-seconds of an inch. The transparency of the dome 10 permits the user to readily perceive the spraying operation and to determine whether the spray is being applied to the vegetation as desired. It should be appreciated that other dome structures may also be advantageously used in connection with the spray guard of the present invention.

Figure 3:
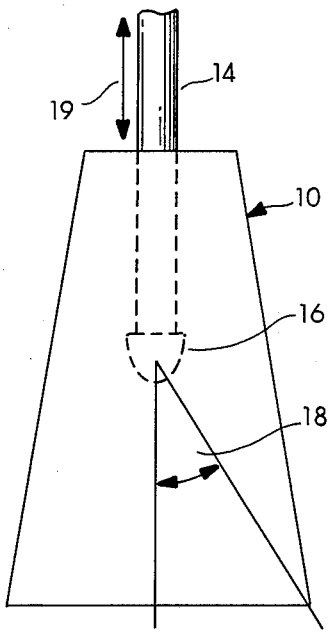
FIG. 3 is a side view of the spray guard shown in FIG. 1 mounted on a discharge tube.

As best shown in FIG. 3, the wand includes a cylindrically shaped discharge tube 14, which may be formed of a variety of different materials, and which may be either rigid or flexible. The wand shown in FIG. 3 includes a nozzle tip 16 releaseably attached, such as by screw threads, to the end of the discharge tube 14. As shown in FIG. 3, the circumference of the discharge tube 14 is smaller than the circumference of the nozzle tip 16, or stated differently, the width of the discharge tube 14 in a direction orthogonal to the longitudinal axis of the discharge tube is shorter than the width of the nozzle tip !6 in a direction orthogonal to the longitudinal axis of the discharge tube 14. In this embodiment of the present invention, the aperture 12 in the dome 10 possesses a diameter larger than the width of the discharge tube 14, and smaller than the width of the nozzle tip 16. The dome 10 may be mounted on the wand by disattaching the nozzle tip 16 from the discharge tube 14, inserting the discharge tube 14 through the aperture 12, and reattaching the nozzle tip 16. The dome 10 is thereby mounted on the discharge tube 14 and is adapted to freely translate relative to the discharge tube 14.

Because of the free translatability of the dome 1 relative to the discharge tube 14, the angle at which the spray emanates from the dome 10 may be selectively varied. As best shown in FIG. 3, the spray emanates from the nozzle 16 at a maximum angle 18. The number of degrees of the maximum angle 18 may be varied by translating the dome 10 relative to the discharge tube 14 in the direction of arrow 19. Thus, the angle 18 may be varied to provide a substantial range of different angles at which the spray is dispersed. If the spray is intended to be directed to a relatively small plant, then the dome 10 may be translated relative to the discharge tube 14 so that the angle 18 is relatively small, and contrastingly, if the spray is adapted to be directed to a relatively large shrub, then the dome 10 may be translated relative to the discharge tube 14 so that the angle 18 is relatively large. Such translation may be accomplished by manually grasping and moving the dome 10 to a selected position relative to the dome 10.

Figure 4:
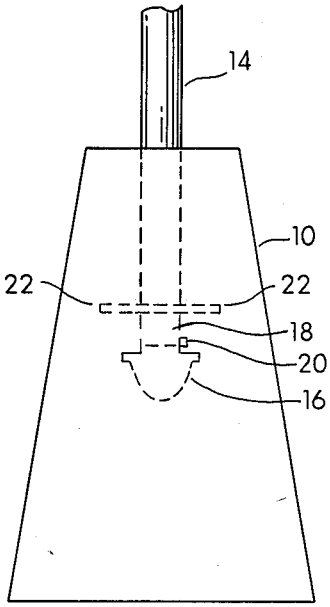
FIG. 4 is a side view of a spray guard in accordance with another embodiment of the present invention mounted on a discharge tube.

There is shown in FIG. 4 a dome 10 mounted on a discharge tube 14 to which a nozzle tip 16 is attached. In the embodiment shown in FIG. 4, the nozzle tip 16 may be fixedly attached to the discharge tube 14 or may be releaseably attached to the discharge tube 14 and smaller than the circumference of the discharge tube 14. In the embodiment shown in FIG. 4, the aperture 12 of the dome 10 is large enough so that both the nozzle tip 16 and the discharge tube 14 may be inserted through the aperture 12. In order to selectively prevent the nozzle tip 16 from totally withdrawing back through the aperture 12, a clamp 18 may be mounted on a discharge tube 14, adjacent to the nozzle tip 16. The clamp 18 may include a tightening screw 20 and one or more ears 22 extending radially outward from the discharge tube 14. The ears 22 are rigid and relatively rigidly clamped to the discharge tube 14 so as to prevent the nozzle tip 16 from being retracted through the aperture 12. The ears 22 may be replaced by a ring surrounding the periphery of the discharge tube 14. In order to disattach the dome 10 from the discharge tube 14, the clamp 18 is simply removed from the discharge tube 14. Since the dome 10 is freely translatable with respect to the discharge tube 14 in the embodiment of the present invention shown in FIG. 4, the angle of the spray emanating from the dome 10 may be varied in the same manner as previously described with reference to FIG. 3.

Although particular embodiments of the present invention have been described and illustrated herein, it should be recognized that modifications and variations may readily occur to those skilled in the art and that such modifications and variations may be made without departing from the spirit and scope of my invention. Consequently, my invention as claimed below may be practiced otherwise than a specified described above.

I claim:

1. A spray guard adapted for use with a wand for spraying a liquid onto vegetation, the wand having a substantially cylindrically shaped discharge tube and a nozzle tip adapted to be selectively releasably attached to an end of the discharge tube such that the liquid may flow through the discharge tube, through the nozzle tip, and onto the vegetation, the nozzle tip having a width in a direction substantially orthogonal to the longitudinal axis of the discharge tube that is greater than the width of the discharge tube in a direction substantially orthogonal to the longitudinal axis of the discharge tube, said spray guard comprising:

a dome having an open end and provided with an aperture, said dome being fashioned of a rigid, inflexible material surrounding the aperture such that the size of the aperture is constant, the width of the aperture being larger than the discharge tube width and smaller than the nozzle tip width whereby the dome may be mounted on the discharge tube only by disattaching the nozzle tip from the discharge tube, inserting and extending the discharge tube through the aperture, and reattaching the nozzle tip to the discharge tube while the discharge tube is extended through the aperture, and whereby the discharge tube may freely translate through the aperture after the nozzle tip has been reattached.

2. A spray guard according to claim 1 wherein said dome is substantially entirely fashioned of a rigid, inflexible material.

3. A spray guard according to claim 1 wherein said dome is fashioned substantially in the shape of a funnel having a first open end and a smaller second end in which the aperture is disposed.

4. A spray guard according to claim 2 wherein said dome is fashioned substantially in the shape of a truncated pyramid having a base end and a smaller upper end, the base end being the open end of said dome and the aperture being disposed in the upper end of said dome.

5. A spray guard according to claim 1 wherein said dome is fashioned substantially entirely of transparent plastic.

6. A spray guard adapted for use with a wand for spraying a liquid onto vegetation, the wand having a substantially cylindrical shaped discharge tube and a nozzle tip attached to an end of the discharge tube such that the liquid may flow through the discharge tube, through the nozzle tip, and onto the vegetation, said spray guard comprising:

a dome having an open end and provided with an aperture, said dome being fashioned of a rigid, inflexible material surrounding the aperture such that the size of the aperture is constant, the size of the aperture being large enough to permit both the nozzle tip and the discharge tube to be inserted and extended therethrough; and means for selectively preventing the nozzle tip from being retracted back through the aperture after the nozzle tip has been inserted through the aperture and for permitting the discharge tube to freely translate through the aperture when the nozzle tip is prevented by said preventing means from being retracted back through the aperture.

7. A spray guard according to claim 6 wherein said preventing means comprises a clamp adapted to be selectively, releasably mounted adjacent to the nozzle tip.

8. A spray guard according to claim 7 wherein said preventing means comprises at least one ear extending substantially orthogonal to the longitudinal axis of the discharge tube.

9. A spray guard according to claim 7 wherein said preventing means comprises a ring adapted to surround the discharge tube.

10. A spray guard according to claim 6 wherein said dome is substantially entirely fashioned of a rigid, inflexible material.

11. A spray guard according to claim 6 wherein said dome is fashioned substantially in the shape of a funnel having a first open end and a smaller second end in which the aperture is disposed.

12. A spray guard according to claim 6 wherein said dome is fashioned substantially in the shape of a truncated pyramid having a base end and a smaller upper end, the base end being the open end of said dome and the aperture being disposed in the upper end of said dome.

13. A spray guard according to claim 6 wherein said dome is fashioned substantially entirely of transparent plastic.

14. A spray guard according to claim 6 wherein said dome is substantially entirely fashioned of a rigid, inflexible material.

15. A spray guard according to claim 6 wherein said dome is fashioned substantially in the shape of a funnel having a first open end and a smaller second end in which the aperture is disposed.

16. A spray guard according to claim 6 wherein said dome is fashioned substantially in the shape of a truncated pyramid having a base end and a smaller upper end, the base end being tee open end of said dome and the aperture being disposed in the upper end of said dome.

17. A spray guard according to claim 6 wherein said dome is fashioned substantially entirely of transparent plastic.

* * * * *